US010041449B2

(12) United States Patent
Dudar

(10) Patent No.: US 10,041,449 B2
(45) Date of Patent: Aug. 7, 2018

(54) EVAPORATIVE EMISSIONS TESTING USING INDUCTIVE HEATING

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 167 days.

(21) Appl. No.: 14/866,305

(22) Filed: Sep. 25, 2015

(65) Prior Publication Data

US 2017/0089304 A1 Mar. 30, 2017

(51) Int. Cl.
*F02M 25/08* (2006.01)
*F02M 65/00* (2006.01)

(52) U.S. Cl.
CPC ..... *F02M 25/0818* (2013.01); *F02M 65/003* (2013.01)

(58) Field of Classification Search
CPC .... G01M 3/08; G01M 15/00; F02M 25/0818; F02M 25/0881; F02M 65/003; F02M 33/02; G01D 18/00
See application file for complete search history.

(56) References Cited

U.S. PATENT DOCUMENTS 5,651,350 A * 7/1997 Blomquist ..... F02M 25/0818 123/520
6,177,662 B1 1/2001 Rutledge
6,357,288 B1 * 3/2002 Shigihama ..... F02M 25/0809 73/114.39
6,389,882 B1 * 5/2002 Ohkuma ..... F02M 25/0818 73/114.39
9,073,442 B2 7/2015 Ichikawa
2007/0131505 A1 6/2007 Kim
2011/0309069 A1 12/2011 Fujinami et al.
2012/0152210 A1 6/2012 Reddy et al.
2013/0249682 A1 9/2013 Van Wiemeersch et al.
2013/0297178 A1 * 11/2013 Hill ..... F02D 41/00 701/102
2013/0297234 A1 * 11/2013 Criel ..... G01M 3/26 702/51
2014/0076285 A1 * 3/2014 Martin ..... F02M 37/0076 123/495
2014/0303830 A1 * 10/2014 Dudar ..... F02M 25/0809 701/29.1
2015/0075501 A1 3/2015 Peters et al.
2015/0090006 A1 4/2015 Peters et al.
(Continued)

*Primary Examiner* — Natalie Huls
(74) *Attorney, Agent, or Firm* — Julia Voutyras; McCoy Russell LLP

(57) ABSTRACT

Methods and systems are provided for conducting an evaporative emissions test on a fuel tank and an evaporative emissions system in a vehicle. In one example, pressure for the evaporative emissions test is provided by inductive heating of the fuel tank while the vehicle undergoes an inductive battery charging operation. In this way, evaporative emissions testing may be enabled under conditions wherein sufficient heat rejection from the engine to the fuel tank is not available, and further enables evaporative emissions testing without the use of an external pump thus eliminating additional costs, and reducing the space occupied in the vehicle for evaporative emissions testing diagnostics.

8 Claims, 6 Drawing Sheets

(56) References Cited

U.S. PATENT DOCUMENTS

| | | | | |
|---|---|---|---|---|
| 2016/0082847 | A1* | 3/2016 | Asai | B60L 11/182 307/10.1 |
| 2017/0167909 | A1* | 6/2017 | Dudar | G01F 23/18 |
| 2017/0226967 | A1* | 8/2017 | Dudar | F02M 25/0818 |

* cited by examiner

EVAPORATIVE EMISSIONS TESTING USING INDUCTIVE HEATING

FIELD

The present description relates generally to methods and systems for actively pressurizing a fuel system and evaporative emissions system for identifying undesired vapor emissions.

BACKGROUND/SUMMARY

Fuel contained in automobile gas tanks presents a source of potential emission of hydrocarbons into the atmosphere. Such emissions from vehicles are termed 'evaporative emissions'. To prevent evaporative emissions from being discharged into the atmosphere, vehicles may be equipped with evaporative emission control systems (Evap). For example, an Evap system may include a fuel vapor canister coupled to a fuel tank which includes a fuel vapor adsorbent for capturing fuel vapors from the fuel tank while providing ventilation of the fuel tank to the atmosphere. As such, the Evap system may be configured to store refueling vapors, running-loss vapors, and diurnal emissions in the fuel vapor canister, and then purge the stored vapors during subsequent engine operation. The stored vapors may be routed to engine intake for combustion, further improving fuel economy for the vehicle.

In an effort to meet stringent federal emissions regulations, fuel systems and Evap systems may need to be intermittently diagnosed for the presence of undesired vapor emissions that could release fuel vapors to the atmosphere. Undesired evaporative emissions may be identified using engine-off natural vacuum (EONV) during conditions when a vehicle engine is not operating. For example, a fuel system may be isolated at an engine-off event. The pressure in such a fuel system will increase if the tank is heated further (e.g., from hot exhaust or a hot parking surface) as liquid fuel vaporizes, and the pressure rise may be monitored and an undesired amount of vapor emissions may be indicated based on expected pressure rise or expected rates of pressure rise. Furthermore, as a fuel tank cools down, a vacuum is generated therein as fuel vapors condense to liquid fuel. Similarly, vacuum generation may be monitored and an undesired amount of vapor emissions identified based on expected vacuum development or expected rates of vacuum development.

However, the entry conditions and thresholds for a typical EONV test are based on an inferred total amount of heat rejected into the fuel tank during the previous drive cycle. The inferred amount of heat may be based on engine run-time, integrated mass air flow, miles driven, etc. Thus, hybrid electric vehicles, including plug-in hybrid electric vehicles (HEV's or PHEV's), pose a problem for effectively controlling evaporative emissions. For example, primary power in a hybrid vehicle may be provided by the electric motor, resulting in an operating profile in which the engine is run only for short periods. As such, adequate heat rejection to the fuel tank may not be available for EONV diagnostics.

An alternative to relying on inferred sufficient heat rejection for entry into a typical EONV diagnostic test is to instead actively pressurize or evacuate the fuel system and Evap system via an external source. Toward this end, US Patent Application No. 2015/0090006 A1 teaches conducting undesired evaporative emissions detection in an evaporative emission systems control system by using a pump configured to both pressurize and evacuate the system.

However, the inventors herein have recognized potential issues with such a method. For example, the use of an external pump introduces additional costs, occupies additional space in the vehicle, and includes the potential for malfunction.

Thus, the inventors herein have developed systems and methods to at least partially address the above issues. In one example, a battery of a hybrid vehicle is inductively charged by coupling a magnetic field between a primary coil external to the vehicle and a secondary coil onboard the vehicle. The magnetic field from the primary coil may be further coupled to a ferrous fuel tank or a ferrous member coupled to the tank. In this way, eddy currents may be induced in the ferrous fuel tank or a ferrous member coupled to the fuel tank, thus generating heat that may actively pressurize the fuel system and Evap system to allow for diagnostic evaporative emissions testing.

In one example, fuel system pressure may be monitored subsequent to vehicle operation with a fuel tank isolation valve (FTIV) closed to seal the fuel tank from atmosphere. If steady pressure or vacuum is not indicated, it may be determined whether inductive charging of the vehicle is in progress. If the vehicle is in the process of inductive charging, the FTIV may be maintained closed such that the fuel system is maintained sealed from atmosphere. In the absence of undesired vapor emissions, pressure may build in the fuel system, resulting from the magnetic field induced heating of the fuel tank. If a pressure rise above a reference pressure is indicated during a portion of the charging, it may be determined that vapor emissions in the fuel system are not undesired. Alternatively, if the pressure does not build to a threshold level, undesired vapor emissions in fuel system may be indicated. If undesired vapor emissions in the fuel system are not indicated, a canister side of the Evap system may subsequently be checked for undesired vapor emissions. As such, the FTIV may be commanded open, the CVV commanded or maintained closed, and pressure monitored for a duration. A pressure maintained above a threshold may indicate that evaporative vapor emissions are not undesired, while a pressure decay below a threshold pressure may indicate the presence of undesired vapor emissions. In this way, both the fuel system and the canister side of the Evap system may be actively checked for undesired vapor emissions during an inductive charging operation without the use of an external pump.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2:
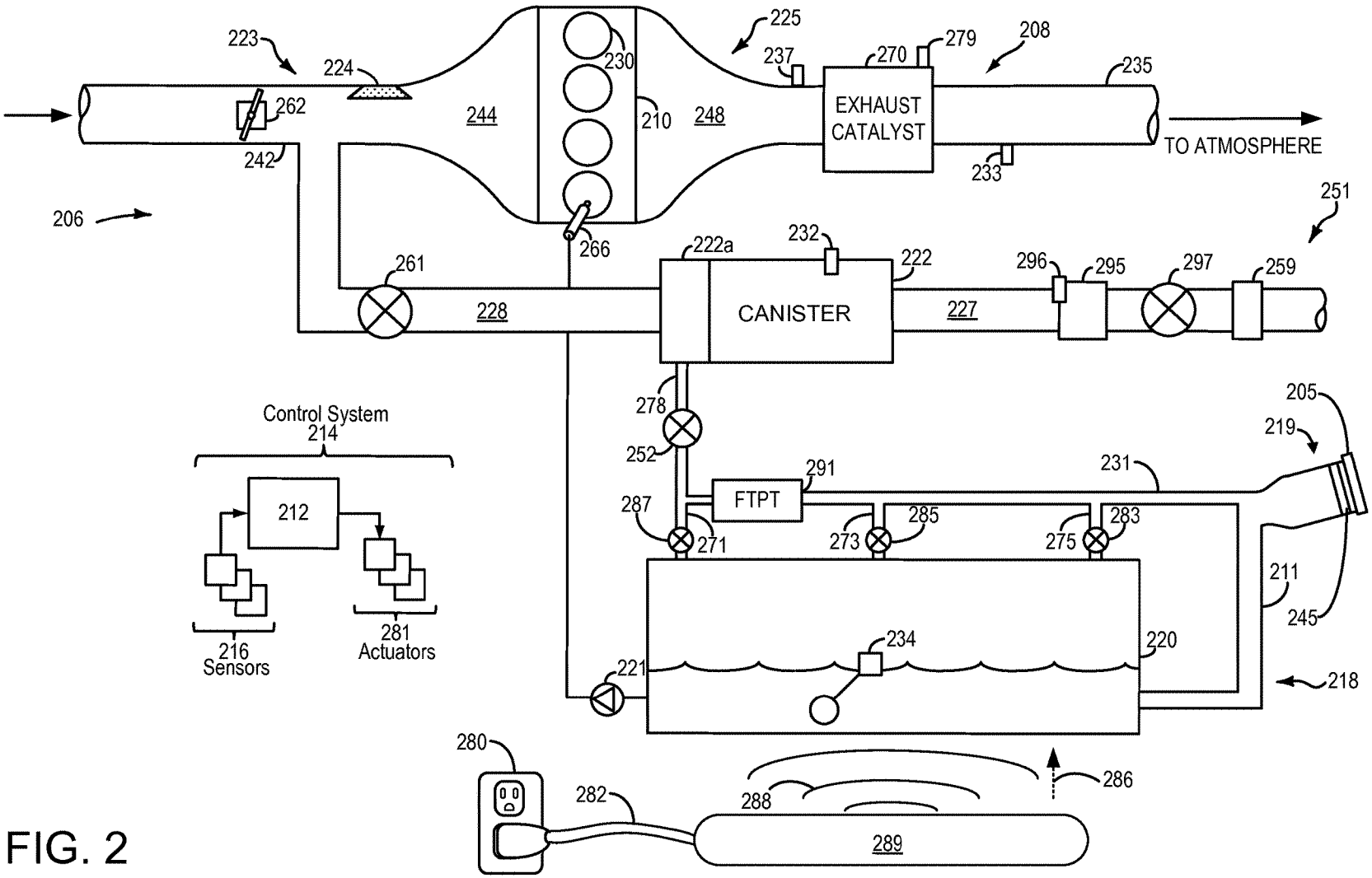
FIG. 2 schematically shows an example vehicle system with a fuel system and an evaporative emissions system.
Figure 3:
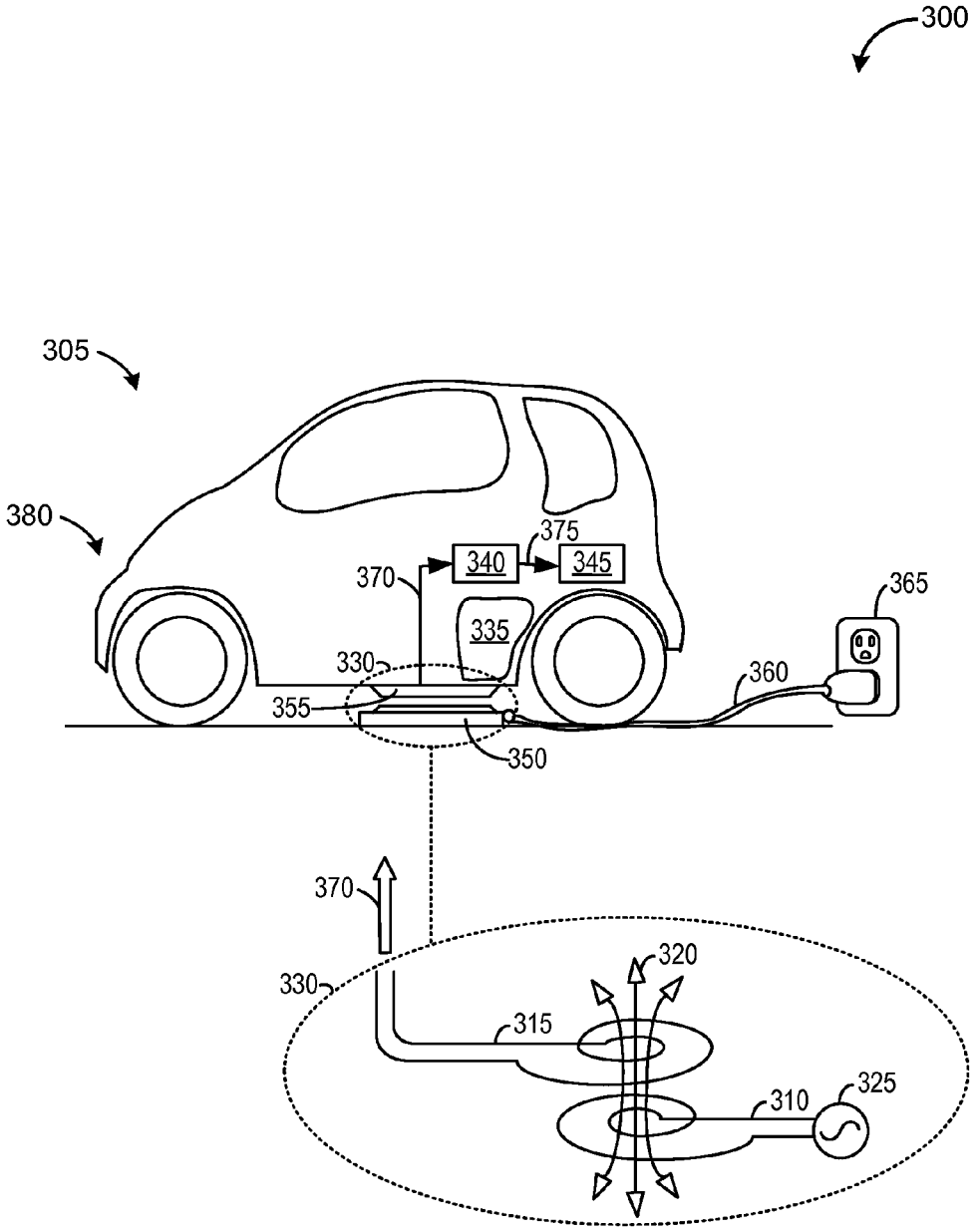
FIG. 3 schematically shows an inductive charging system for a vehicle.
Figure 4:
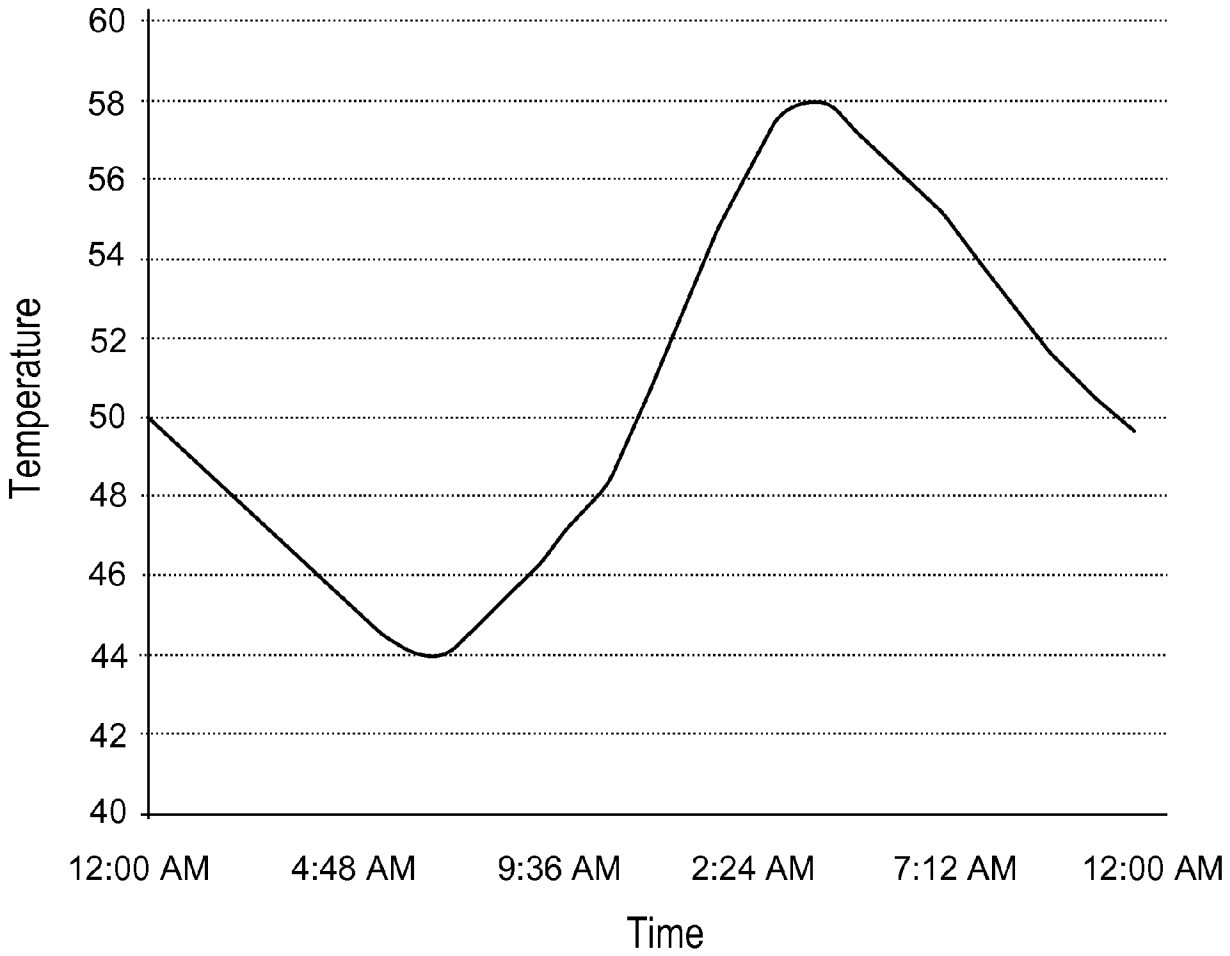
FIG. 4 shows an example diurnal cycle.
Figure 5:
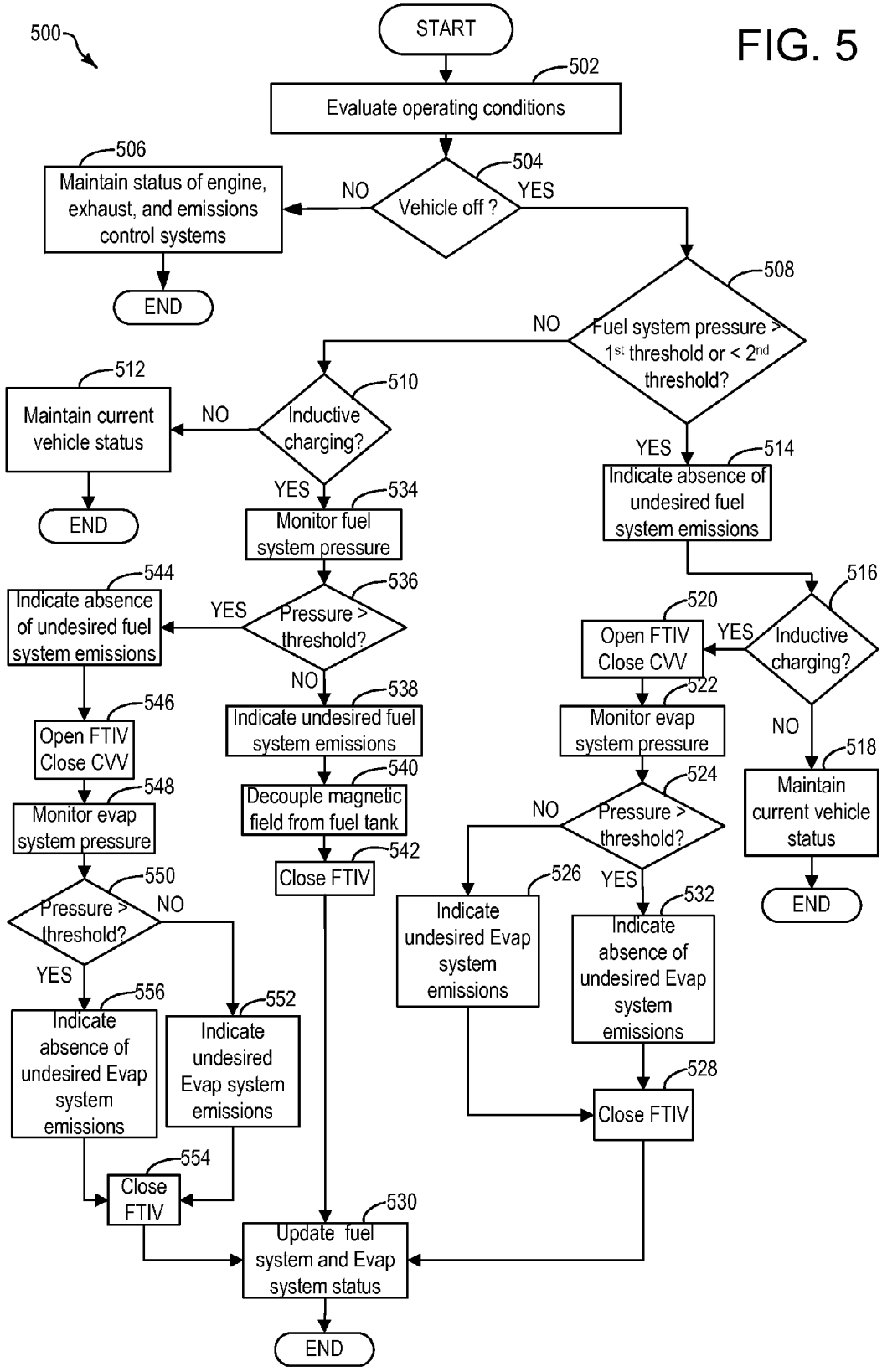
FIG. 5 shows a flowchart for an example method for performing an evaporative emissions test wherein pressure for the test is generated via inductive heating of the fuel tank.
Figure 6:
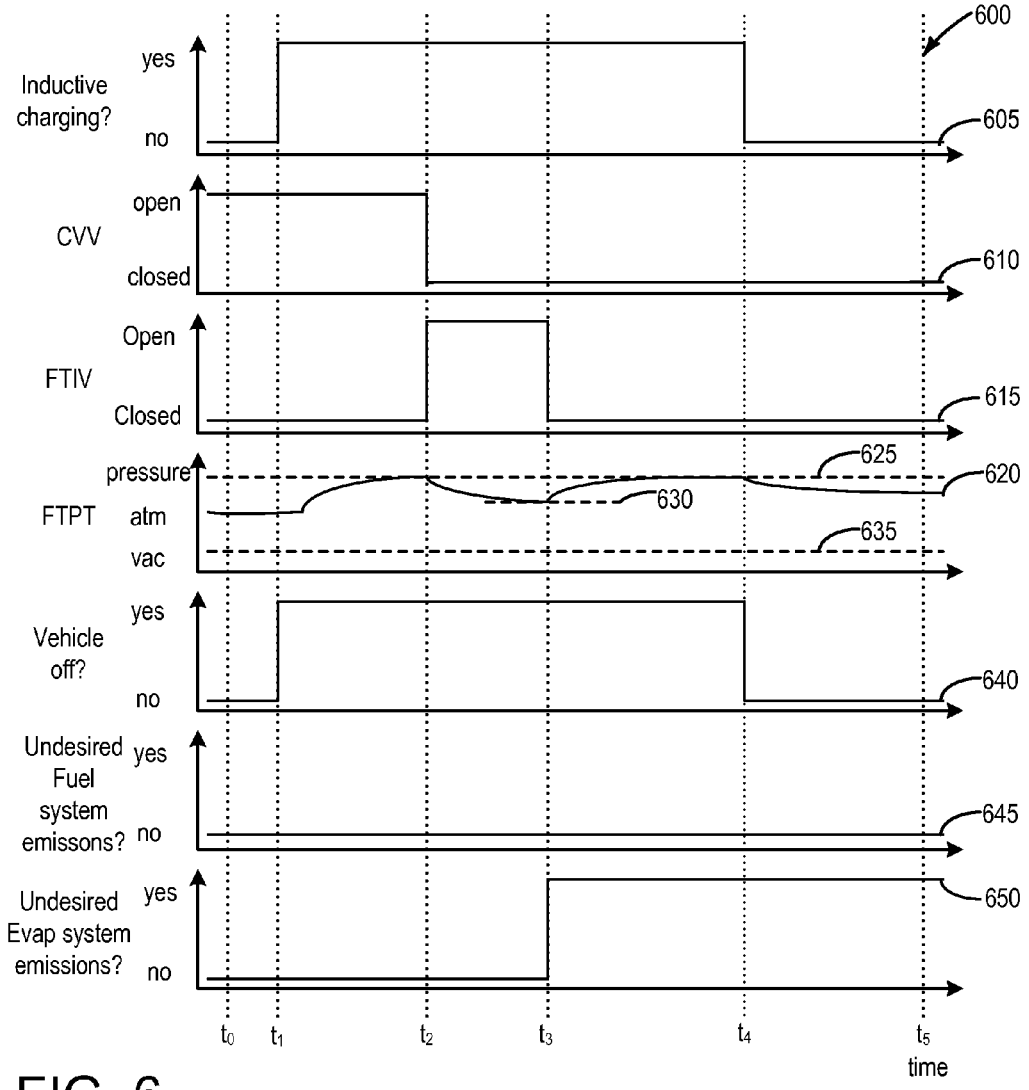
FIG. 6 shows a timeline for an example evaporative emissions test procedure.

The following detailed description relates to systems and methods for performing an evaporative emissions test on a fuel system and an evaporative emissions system using inductive heating of the fuel tank to provide pressure for the evaporative emissions test while the vehicle is undergoing inductive charging of the battery. Specifically, the description relates to charging a battery of a hybrid vehicle by coupling a magnetic field between a primary coil external to the vehicle and a secondary coil onboard the vehicle. The magnetic field may be further coupled between the primary coil external to the vehicle and a ferrous fuel tank or ferrous member coupled to the tank. As such, while the vehicle is charging, the fuel tank may be heated such that pressure may be generated for robust evaporative emissions testing diagnostics. The systems and methods may be applied to a vehicle system capable of inductive charging of the vehicle battery, and inductive heating of the fuel tank, such as the hybrid vehicle system depicted in FIG. 1. In one example, the primary coil external to the vehicle may be positioned in close proximity to the fuel tank, wherein the fuel tank is coupled to an emissions control system, and engine, and an exhaust system as depicted in FIG. 2. An alternating current (AC) power source may supply power to the primary coil, thus generating a magnetic field such that an alternating current is induced in the secondary coil, which may then be converted into direct current (DC) for charging a battery, as depicted in FIG. 3. Further, the magnetic field generated from the primary coil may be coupled to the fuel tank, thus heating the fuel tank during an inductive charging operation. During a vehicle-off condition the fuel tank may be monitored in order to determine whether the tank is maintaining a steady pressure or vacuum. The absence of steady pressure or vacuum may be the result of insufficient heat rejection from the engine to the fuel tank during a previous drive cycle, the vehicle in a portion of the diurnal temperature cycle where the fuel tank is atmospheric pressure, as depicted in FIG. 4, or alternatively the absence of steady pressure or vacuum may be the result of undesired vapor emissions. If steady pressure or vacuum is not indicated, inductive heating of the fuel tank during an inductive battery charging operation may thus provide pressure for conducting an evaporative emissions test on the fuel system and the Evap system according to the method depicted in FIG. 5. A timeline for performing an evaporative emissions test using pressure generated by inductive heating of the fuel tank using the method of FIG. 5 is shown in FIG. 6.

Figure 1:
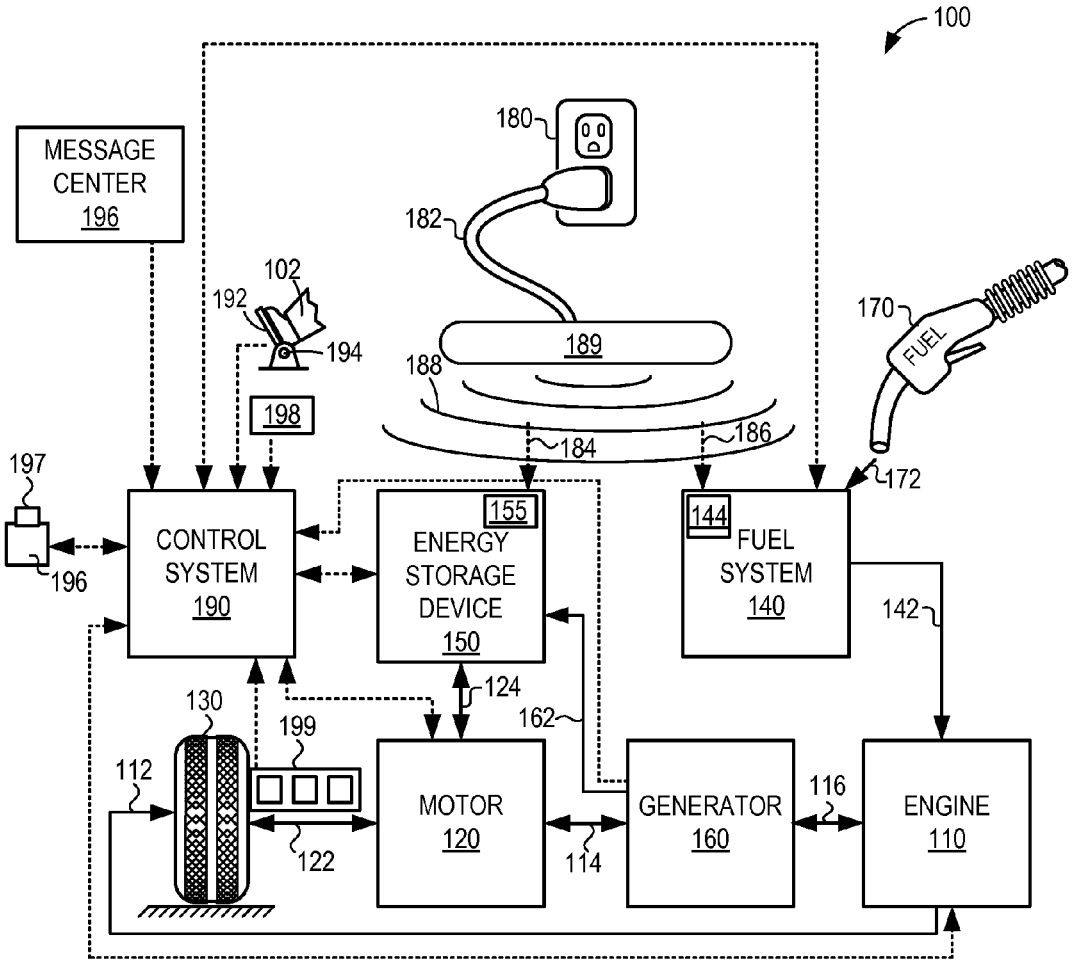
FIG. 1 schematically shows an example vehicle propulsion system.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160 as indicated by arrow 116, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle). As a non-limiting example, vehicle propulsion system 100 may be configured as a plug-in hybrid electric vehicle (HEV), whereby electrical energy may be supplied to energy storage device 150 from power source 180 via an electrical energy transmission cable (not shown). While the vehicle propulsion system is operated to propel the vehicle, electrical transmission cable may disconnected between power source 180 and energy storage device 150. Control system 190 may identify and/or control the amount of electrical energy stored at the energy storage device, which may be referred to as the state of charge (SOC).

In other embodiments, physical connection between power source 180 and the vehicle via an electrical transmission cable may be omitted, where electrical energy may be received wirelessly at energy storage device 150 from power source 180. In one example, an alternating current (AC) power source 180 may supply power to a charging mat 189 via an electrical transmission cable 182. AC power supplied to the charging mat 189 may generate a magnetic field 188 that may be transmitted to the vehicle, indicated by arrow 184, wherein the alternating current may be converted into direct current via an AC/DC rectifier 155 for storage at energy storage device 150. As such electrical energy may be received wirelessly from power source 180 via electromagnetic induction. Moreover, it may be appreciated that energy storage device 150 may receive electrical energy from power source 180 via any suitable approach for recharging energy storage device 150 from a power source that does not comprise part of the vehicle. In this way, motor 120 may propel the vehicle by utilizing an energy source other than the fuel utilized by engine 110.

In one example, charging mat 189 may be positioned in close proximity to fuel tank 144. If the fuel tank 144 is comprised of ferrous material, as in the fuel tank of a PHEV, the magnetic field 188 generated by charging mat 189 may inductively heat fuel tank 144, indicated by arrow 186. In other examples, for instance a fuel tank comprised of aluminum or plastic, magnetic field 188 generated during an inductive charging operation may be coupled to a ferrous member (not shown) that in turn may be coupled to the fuel tank 144 such that the fuel tank may in turn be heated. As will be described in further detail below with regard to the systems discussed in FIGS. 2-3, and in regard to the method described in FIG. 5, inductive heating of fuel tank 144 may function to actively generate pressure that may be subsequently used in order to diagnose vapor emissions in the fuel system 140, and evaporative emissions system (not shown).

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

FIG. 2 shows a schematic depiction of a vehicle system 206. The vehicle system 206 includes an engine system 208 coupled to an evaporative emissions control (Evap) system 251 and a fuel system 218. Evap system 251 includes a fuel vapor container or canister 222 which may be used to capture and store fuel vapors. In some examples, vehicle system 206 may be a hybrid electric vehicle (HEV) system or a plug-in hybrid electric vehicle system (PHEV).

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more exhaust catalyst 270, which may be mounted in a close-coupled position in the exhaust. Exhaust catalyst may include a temperature sensor 279. In some examples one or more emission control devices may include a three-way catalyst, lean NOx trap, diesel particulate filter, oxidation catalyst, etc. It will be appreciated that other components may be included in the engine such as a variety of valves and sensors.

An air intake system hydrocarbon trap (AIS HC) 224 may be placed in the intake manifold of engine 210 to adsorb fuel vapors emanating from unburned fuel in the intake manifold, puddled fuel from leaky injectors and/or fuel vapors in crankcase ventilation emissions during engine-off periods. The AIS HC may include a stack of consecutively layered polymeric sheets impregnated with HC vapor adsorption/desorption material. Alternately, the adsorption/desorption material may be filled in the area between the layers of polymeric sheets. The adsorption/desorption material may include one or more of carbon, activated carbon, zeolites, or any other HC adsorbing/desorbing materials. When the engine is operational causing an intake manifold vacuum and a resulting airflow across the AIS HC, the trapped vapors are passively desorbed from the AIS HC and combusted in the engine. Thus, during engine operation, intake fuel vapors are stored and desorbed from AIS HC 224. In addition, fuel vapors stored during an engine shutdown can also be desorbed from the AIS HC during engine operation. In this way, AIS HC 224 may be continually loaded and purged, and the trap may reduce evaporative emissions from the intake passage even when engine 210 is shut down.

Fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an Evap system 251 which includes a fuel vapor canister 222 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222 filled with an appropriate adsorbent, the canisters are configured to temporarily trap fuel vapors (including vaporized hydrocarbons) during fuel tank refilling operations, "running loss" (that is, fuel vaporized during vehicle operation), and diurnal cycles. In one example, the adsorbent used is activated charcoal. Emissions control system 251 may further include a canister ventilation path or vent line 227 which may route gases out of the canister 222 to the atmosphere when storing, or trapping, fuel vapors from fuel system 218.

Canister 222 may include a buffer **222*a* (or buffer region), each of the canister and the buffer comprising the adsorbent. As shown, the volume of buffer 222*a* may be smaller than (e.g., a fraction of) the volume of canister 222. The adsorbent in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222**. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake manifold 244 is provided to the fuel vapor canister for purging. In some examples, vent line 227 may include an air filter 259 disposed therein upstream of a canister 222.

In some examples, the flow of air and vapors between canister 222 and the atmosphere may be regulated by a canister vent valve (CVV) 297 coupled within vent line 227. When included, the canister vent valve may be a normally open valve, so that fuel tank isolation valve 252 (FTIV) may control venting of fuel tank 220 with the atmosphere. FTIV 252 may be positioned between the fuel tank and the fuel vapor canister within conduit 278. FTIV 252 may be a normally closed valve, that when opened, allows for the venting of fuel vapors from fuel tank 220 to canister 222. Fuel vapors may then be vented to atmosphere, or purged to engine intake system 223 via canister purge valve 261.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open isolation valve 252 while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open isolation valve 252, while maintaining canister purge valve 261 closed, to depressurize the fuel tank before enabling fuel to be added therein. As such, isolation valve 252 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 212 may open canister purge valve 261 while closing isolation valve 252. Herein, the vacuum generated by the intake manifold of the operating engine may be used to draw fresh air through vent 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold.

Undesired vapor emissions detection routines may be intermittently performed by controller 212 on fuel system 218 and evaporative emissions system 251 to confirm that the fuel system 218 and evaporative emission system 251 are not degraded. As such, evaporative emissions testing may be performed while the engine is off (engine-off test) using engine-off natural vacuum (EONV) generated due to a change in temperature and pressure at the fuel tank following engine shutdown. For example, responsive to an engine-off event, a fuel system may be isolated and the pressure in the fuel system may be monitored. Identification of undesired vapor emissions may be indicated based on a pressure rise below a threshold, or a rate of pressure rise below a threshold rate. Furthermore, as the fuel tank cools down, vacuum generation may be monitored and undesired vapor emissions identified based on development of a vacuum below a threshold, or a rate of vacuum development below a threshold rate. However, as entry conditions and thresholds for typical EONV tests may be based on an inferred total amount of heat rejected to the fuel tank during a previous drive cycle, adequate heat rejection to the fuel tank may not be available for EONV evaporative emissions diagnostics in HEVs or PHEVs, where primary power may be provided by the electric motor. As such, under conditions wherein adequate heat rejection to the fuel tank during a previous drive cycle is not available, fuel system 218 and evaporative emissions system 251 may instead be actively pressurized (or evacuated) via an external source. In one example, as described above with regard to the vehicle system depicted in FIG. 1, a power source 280 may be coupled to a charging mat 289 via an electrical transmission cable 282. Power supplied to the charging mat 289 may generate a magnetic field 288 that may be transmitted to the vehicle in order to wirelessly charge a vehicle battery via an inductive charging operation. During an inductive charging operation, a ferrous fuel tank 220 positioned in close proximity to charging mat 289 may be inductively heated, indicated by arrow 286, where heat generated in the fuel tank 220 may in turn generate pressure that may be used to diagnose undesired vapor emissions in the fuel system 218 and evaporative emissions system 251. In other examples, where the fuel tank comprises an aluminum or plastic fuel tank, a ferrous member may instead be inductively charged in order to heat the fuel tank.

In alternate examples, evaporative emissions testing routines may be performed while the engine is running by using engine intake manifold vacuum, or while the engine is either running or during engine-off conditions by operating a vacuum pump. Evaporative emissions tests may be performed by an evaporative emissions check module 295 communicatively coupled to controller 212. Evaporative emissions check module 295 may be coupled in vent 227, between canister 222 and the atmosphere. Evaporative emissions check module 295 may include a vacuum pump for applying negative pressure to the fuel system when administering an evaporative emissions test. In some embodiments, the vacuum pump may be configured to be reversible. In other words, the vacuum pump may be configured to apply either a negative pressure or a positive pressure on the fuel system. Evaporative emissions check module 295 may further include a reference orifice and a pressure sensor 296. Following the applying of vacuum to the fuel system, a change in pressure at the reference orifice (e.g., an absolute change or a rate of change) may be monitored and compared to a threshold. Based on the comparison, an undesired amount of vapor emissions may be indicated. However, as the use of an external pump introduces additional costs, occupies additional space in the vehicle, and includes the potential for malfunction, under conditions where inductive heating of the fuel tank 220 may be utilized to actively pressurize the fuel system 218 and evaporative emissions system 251 during inductive charging operations, the use of an external pump such as evaporative emissions check module 295 may be omitted.

In some configurations, a canister vent valve (CVV) 297 may be coupled within vent line 227. CVV 297 may function to adjust a flow of air and vapors between canister 222 and the atmosphere. The CVV may also be used for diagnostic routines. When included, the CVV may be opened during fuel vapor storing operations (for example, during fuel tank refueling and in some cases while the engine is not running) so that air, stripped of fuel vapor after having passed through the canister, can be pushed out to the atmosphere. Likewise, during purging operations (for example, during canister regeneration and while the engine is running), the CVV may be opened to allow a flow of fresh air to strip the fuel vapors stored in the canister. In some examples, CVV 297 may be a solenoid valve wherein opening or closing of the valve is performed via actuation of a canister vent solenoid. In particular, the canister vent valve may be a default open valve that is closed upon actuation of the canister vent solenoid. In some examples, CVV 297 may be configured as a latchable solenoid valve. In other words, when the valve is placed in a closed configuration, it latches closed without requiring additional current or voltage. For example, the valve may be closed with a 100 ms pulse, and then opened at a later time point with another 100 ms pulse. In this way, the amount of battery power required to maintain the CVV closed is reduced.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device, temperature sensor 233, pressure sensor 291 (fuel tank pressure transducer), and canister temperature sensor 232. Other sensors such as pressure, temperature, air/fuel ratio, and composition sensors may be coupled to various locations in the vehicle system 206. As another example, the actuators may include fuel injector 266, throttle 262, fuel tank isolation valve 252, CPV 261 and refueling lock 245. The controller 212 may receive input data from the various sensors, process the input data, and trigger the actuators in response to the processed input data based on instruction or code programmed therein corresponding to one or more routines. An example control routine is described herein with regard to FIG. 5.

In some examples, the controller may be placed in a reduced power mode or sleep mode, wherein the controller maintains essential functions only, and operates with lower battery consumption than in a corresponding awake mode. For example, the controller may be placed in a sleep mode following a vehicle-off event in order to perform a diagnostic routine at a duration following the vehicle-off event. The controller may have a wake input that allows the controller to be returned to an awake mode based on an input received from one or more sensors. In one example, further described below and with regard to FIGS. 5-6, a pressure rise in the fuel system 218 and Evap system 251 above a threshold desired level during an inductive charging operation may trigger a return to an awake mode such that a method stored in the controller may be executed in order to decouple the magnetic field from the fuel tank.

FIG. 3 schematically shows an induction charging system for a vehicle. As shown in this figure, the wireless charging system 305 includes a vehicle 380, the vehicle comprising a plug-in hybrid electric vehicle (PHEV). In some examples, vehicle 380 may comprise an electrically powered vehicle without a combustion engine. An alternating current (AC) power source 365 supplies power to a charging mat 350 via an electrical transmission cable 360. When AC power 365 is supplied to the charging mat 350, a magnetic field is generated wherein power is transmitted to a pickup mat 355 located on the vehicle 380 in a non-contact manner. More specifically, charging mat 350 contains a primary coil 310, and pickup mat 355 contains a secondary coil 315. When the primary coil is electrically charged, a magnetic field 320 is generated such that a current is induced in the secondary coil 315. Current induced in the secondary coil may be transmitted to an AC/DC rectifier 340, indicated by arrow 370, wherein alternating current may be converted into direct current for charging a battery 345, indicated by arrow 375.

The secondary coil 315 in the pickup mat 355 may be positioned in close proximity to a fuel tank 335. As such, during an inductive charging operation where the primary coil 310 in the charging mat 350 is positioned in close proximity to the secondary coil 315 in the pickup mat 355, the primary coil may be further positioned in close proximity to the fuel tank 335. If the fuel tank 335 is comprised of ferrous material, as in, for example, the fuel tank of a PHEV, the resulting magnetic field 320 from the primary coil 310 may inductively heat the fuel tank. Alternatively, if the fuel tank is not comprised of ferrous material, and instead is comprised of aluminum or plastic, for example, the magnetic field 320 generated from the primary coil 310 may be coupled to a ferrous member (not shown) that is in turn coupled to the fuel tank 335 such that heat generated in the ferrous member may heat the fuel tank 335. In some examples the ferrous member may comprise a metal plate, or existing ferrous material on the vehicle, for instance the vehicle frame, exhaust, or fuel tank brackets.

Positioning the secondary coil 315 in close proximity to the fuel tank 335 may not be practical in some instances, due to space constraints in the vehicle, for example. In such an example, the magnetic field 320 induced by the primary coil 310 may not sufficiently heat a ferrous fuel tank 335, or in other words the magnetic field 320 from the primary coil 310 may be uncoupled from the ferrous fuel tank 335. As described above, in such circumstances, the magnetic field 320 from the primary coil 310 may be coupled to the ferrous fuel tank (or an aluminum or plastic tank) via a ferrous member. As such, even under circumstances where vehicle space is limited, heat may be effectively transferred to the fuel tank during an inductive charging operation.

As described above with regard to FIG. 2, inductive heating of the fuel tank 335 during an inductive charging operation may actively generate pressure that may be utilized for fuel system and Evap system evaporative emissions testing. By actively heating the fuel tank during an inductive charging operation, pressure may be provided for evaporative emissions testing under circumstances wherein sufficient heat was not rejected from the engine during a previous drive cycle, and/or during conditions where pressure or vacuum is not present in the fuel tank due to diurnal temperature cycle fluctuations, as described below with regard to FIG. 4. However, if undesired vapor emissions are identified in the fuel system during an inductive charging operation wherein pressure is actively generated via inductive heating of the fuel tank, further heating of the fuel tank may result in vapor generation that may escape from the fuel tank to the atmosphere. As such, responsive to the indication of undesired fuel system vapor emissions during an inductive charging operation, the magnetic field 320 may be decoupled from the fuel tank 335 such that the fuel tank 335 is no longer heated, whether or not the fuel tank is comprised of ferrous material or whether heating is provided via a ferrous member coupled to the fuel tank. In one example, decoupling the magnetic field 320 from the fuel tank 335 may comprise shielding the magnetic field 320 from the fuel tank 335 via a ferrous shield (not shown), the ferrous shield comprised of louvers moved to a closed position upon indication of undesired fuel system vapor emissions. Further, responsive to an indication of undesired fuel system vapor emissions, FTIV (e.g., 252), may be commanded open and CVV (e.g., 297), may be commanded open or maintained open. In this way, fuel tank vapors may be directed to the vapor canister (e.g., 222). In another example, decoupling the magnetic field 320 from fuel tank 335 may include stopping an inductive charging operation and alerting a vehicle operator by any suitable means (e.g., alarm, electronic mail, cellular text message) that undesired fuel tank vapor emissions have been identified and that an inductive charging operation has been stopped. Under circumstances wherein an inductive charging operation may be stopped responsive to indicated undesired fuel system vapor emissions, vehicle 380 may be supplied power from power source 365 via an electrical energy transmission cable (not shown) coupled directly to the vehicle 380.

As will be described in further detail below with regard to the method depicted in FIG. 5, responsive to an indication of a fuel system without undesired vapor emissions and an indication of undesired vapor emissions in the evaporative emissions system during an inductive charging operation, if the fuel tank is made of ferrous material, for example a PHEV, FTIV may be commanded closed such that the fuel system may be sealed. As such, inductive charging may proceed, the ferrous fuel tank designed to withstand the pressures associated with an inductive charging event. Similarly, if the fuel tank is not comprised of ferrous material, but instead is heated via a ferrous member coupled to the fuel tank, the ferrous member may be positioned such that the inductive heating of the fuel tank during an inductive operation does not result in pressure generation beyond a desired level. In this way, charging operations may proceed for a sealed fuel tank with an evaporative emissions system indicated to have undesired vapor emissions. However, under some circumstances, pressure in the fuel system may increase above a threshold. In such a circumstance, the magnetic field may be decoupled from the fuel tank as described above, for example via shielding the tank with a ferrous shield, such that further pressure increases in the fuel system are avoided, or by stopping the inductive charging operation. In some examples, responsive to pressure increases above a threshold, mitigating action may further include venting the fuel tank, for example by commanding open a FTIV (e.g. 252). However, if undesired vapor emissions are indicated in the evaporative emissions system, opening an FTIV in order to vent pressure in the fuel tank may lead to undesired evaporative emissions and thus commanding open a FTIV may be reserved for pressure increases above a preselected level.

In the event of an evaporative emissions test wherein undesired vapor emissions are not identified, as will be discussed in further detail below in regard to the method depicted in FIG. 5, by sealing the fuel tank, whether a ferrous fuel tank or an aluminum or plastic fuel tank coupled to a ferrous member, an inductive charging operation may proceed wherein pressure increases beyond desired levels are avoided. Alternatively, in other examples, the fuel tank may be decoupled from the magnetic field during an inductive charging operation, whether the fuel tank comprises a ferrous fuel tank or an aluminum or plastic fuel tank, and may only be coupled to the magnetic field for a duration during an evaporative emissions test in order to actively pressurize the fuel tank. In a condition wherein the fuel tank may be decoupled from the magnetic field subsequent to an indication an absence of undesired vapor emissions during an inductive charging operation, a ferrous fuel tank may be sealed or maintained sealed, while alternatively a fuel system comprised of an aluminum or plastic fuel tank may be configured to direct fuel tank vapors to the vapor canister via opening of FTIV and CVV.

By way of example, FIG. 4 shows an example diurnal cycle as a graph of temperature versus time. As illustrated in the example diurnal cycle in FIG. 4, ambient temperatures naturally increase during the day and decrease at night leading to corresponding temperature fluctuations in the fuel system. For example, as shown in FIG. 4 between approximately 7:00 PM to 5:00 AM ambient temperatures are decreasing leading to a decrease in temperatures in the fuel system and a corresponding increase in vacuum present in the fuel system when sealed from the atmosphere. However, between approximately 5:00 AM and 7:00 PM ambient temperatures are increasing leading to an increase in temperatures in the fuel system and a corresponding increase in pressure present in the fuel system when sealed from the atmosphere. As described below, pressure changes in the fuel system due to these naturally occurring temperature changes may result in circumstances wherein pressure in an intact fuel tank is at or near atmospheric pressure. As such, active pressurization of the fuel system and evaporative emissions system may be conducted in order to diagnose the fuel system and evaporative emissions system for undesired vapor emissions.

A flow chart for a high-level example method 500 for performing an evaporative emissions test on a PHEV configured with a ferrous fuel tank is shown in FIG. 5. More specifically, method 500 includes indicating potential undesired vapor emissions in the fuel tank subsequent to vehicle operation, and responsive to an indication of inductive charging of the vehicle, proceeding with evaporative emissions testing via magnetic field induced heating of the fuel tank to actively pressurize the fuel tank and Evap system. Method 500 will be described with reference to the systems described herein and shown in FIGS. 1-3, though it should be understood that similar methods may be applied to other systems without departing from the scope of this disclosure. For example, method 500 depicts a PHEV configured with a ferrous fuel tank in close proximity to a primary coil contained within an inductive charging mat, thus enabling heating of the fuel tank during an inductive charging operation. However, alternate examples may include a plastic or aluminum tank wherein inductive heating of the fuel tank may be accomplished via coupling the magnetic field to a ferrous member that in turn may be coupled to the fuel tank such that heating of the fuel tank may be accomplished during an inductive charging operation. Method 500 may be carried out by a controller, such as controller 212 in FIG. 2, and may be stored at the controller as executable instructions in non-transitory memory. Instructions for carrying out method 500 and the rest of the methods included herein may be executed by a controller based on instructions stored on a memory of the controller and in conjunction with signals received from sensors of the engine system, such as the sensors described above with reference to FIGS. 1 and 2. The controller may employ engine actuators of the engine system to adjust engine operation, according to the methods described below.

Method 500 begins at 502 and includes evaluating current operating conditions. Operating conditions may be estimated, measured, and/or inferred, and may include one or more vehicle conditions, such as vehicle speed, vehicle location, etc., various engine conditions, such as engine status, engine load, engine speed, A/F ratio, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc. At 504, method 500 includes determining whether a vehicle-off condition is detected. A vehicle-off condition may be indicated by a key-off event, a user setting a vehicle alarm following exiting a vehicle that has been parked, a user depressing a button, or other suitable indicator. If at 504 it is indicated that the vehicle is in operation, method 500 proceeds to 506. At 506, method 500 includes maintaining the current status of engine, exhaust, and emission control systems. In some examples maintaining the current status of emission control systems may include conducting fuel system and Evap system evaporative emissions testing during vehicle-on conditions. For example, if the vehicle is operating with the engine-on, engine manifold vacuum may be used in order to conduct fuel system and Evap system evaporative emissions testing. Method 500 may then end.

If at 504 a vehicle-off condition is indicated, method 500 proceeds to 508 and includes indicating whether a fuel system pressure is greater than a first threshold, or lower than a second threshold. For example, the fuel system pressure may be monitored by a fuel tank pressure transducer, such as FTPT 291 (FIG. 2), for a duration, with the fuel tank isolation valve, such as FTIV 252 (FIG. 2), closed to isolate the fuel system. If sufficient heat was rejected from the engine during a previous drive cycle, a pressure build above a threshold may indicate an intact fuel system. In another example, the vehicle may be in a portion of the diurnal temperature cycle where ambient temperatures are increasing (FIG. 4) leading to an increase in fuel tank temperature such that pressure in the fuel system may build above a threshold to indicate an absence of undesired fuel system vapor emissions. Alternatively, the vehicle may be in a portion of the diurnal temperature cycle where ambient temperatures are decreasing (FIG. 4) leading to a decrease in fuel tank temperature such that a vacuum may build to a threshold indicating an absence of undesired fuel system emissions. If at 508 it is indicated that fuel system pressure is not greater than a first threshold, or below a second threshold, in one example undesired vapor emissions may be present in the fuel system resulting in the inability of the fuel system to maintain a pressure or vacuum build. In another example, undesired fuel system vapor emissions may not be indicated, yet sufficient heat was not rejected during a previous drive cycle and the vehicle may be in a portion of the diurnal temperature cycle where ambient temperature may not result in sufficient heating or cooling of the fuel tank (FIG. 4). As such, at 508, if it is indicated that fuel system pressure is not greater than a first threshold, or below a second threshold, undesired fuel system vapor emissions may not be conclusively indicated. Accordingly, method 500 proceeds to 510 and includes indicating whether the vehicle is being charged via inductive charging. For example, inductive charging in progress may be indicated via communication between the energy storage device (e.g. 150, FIG. 1) and the control system (e.g., 190, FIG. 1). If at 510 it is indicated that the vehicle is not being charged via inductive charging, method 500 proceeds to 512 and includes maintaining the current status of the vehicle. For example, at 512, maintaining the current vehicle status may include maintaining the FTIV closed, and the CVV open. In another example, maintaining the current status of the vehicle may include maintaining the FTIV closed and the CVV closed. In still another example, as a potential undesired amount of vapor emissions may be present in the fuel system as indicated at 508 of method 500, at 512 method 500 may include commanding open the FTIV and commanding or maintaining open the CVV such that vapors from the fuel tank are routed to the vapor canister prior to exiting to atmosphere. At 512, maintaining the current vehicle status may further include setting a diagnostic code or flag at the controller, and may further include illuminating a malfunction indicator lamp. Additional tests may be scheduled to determine the nature of the absence of fuel system pressure greater than a first threshold, or below a second threshold at 512. In one example, upon future detection of an inductive charging event, the fuel system may be further assessed for undesired vapor emissions, according to the method 500 described further below.

Returning to 510, if it is indicated that inductive charging of the vehicle is in progress, method 500 proceeds to 534 and includes maintaining the FTIV closed and monitoring fuel system pressure for a duration. The duration at 534 may be a predetermined duration, for example a duration for which a pressure build above a threshold is expected during an inductive charging event for a fuel system in the absence of undesired vapor emissions.

Continuing at 536, method 500 includes indicating whether a fuel system pressure is greater than a threshold. The threshold value may be defined, for example, by a reference pressure obtained under control conditions in the absence of undesired fuel system vapor emissions. The threshold may be further determined based on ambient temperature, fuel tank level, fuel tank temperature, etc. If at 536 it is indicated that the fuel system pressure is not greater than a threshold pressure, method 500 proceeds to 538 and includes indicating undesired fuel system vapor emissions. For example, indicating undesired fuel system vapor emissions may include setting a diagnostic code or flag at the controller, and may further include illuminating a malfunction indicator lamp indicating the vehicle operator to service the vehicle.

As undesired fuel system vapor emissions are indicated at 538, with the FTIV closed and inductive charging in progress, further heating of the fuel tank may result in fuel tank vapors escaping to the atmosphere. As such, at 540, method 500 includes decoupling the magnetic field from the fuel tank. For example, decoupling the magnetic field from the fuel tank at 540 may include shielding the magnetic field from the fuel tank via a ferrous shield. In some examples, the ferrous shield may comprise louvers moved to a closed position upon indication of undesired fuel tank vapor emissions. Alternatively, decoupling the magnetic field from the fuel tank at 540 may include stopping the inductive charging operation and alerting the vehicle operator by any suitable means that undesired fuel system vapor emissions have been identified and that an inductive charging operation has been stopped. As such, under circumstances wherein the inductive charging operation has been stopped, power may be supplied to the vehicle by coupling a power source directly to the vehicle.

Proceeding to 542, method 500 includes opening the FTIV. As undesired fuel system vapor emissions is indicated opening the FTIV may direct at least a portion of vapor from the fuel tank to the vapor canister where the vapor may be adsorbed prior to exiting to atmosphere via an open CVV. For example, the diameter of the opening of a FTIV may be larger than source of undesired fuel system vapor emissions, such that fuel tank vapor may preferentially travel from the fuel tank to the vapor canister rather than travel from the fuel tank to the atmosphere. As such, an amount of evaporative emissions emitted to the atmosphere may be limited prior to servicing the vehicle.

Continuing at 530, method 500 includes updating the status of the fuel system and evaporative emission control system. In one example, updating the status of the fuel system and evaporative emissions system at 530 may include suspending inductive charging operations prior to servicing the vehicle in order to repair the indicated undesired fuel system vapor emissions. Other examples of updating the status of the fuel system and evaporative emissions system at 530 may comprise shielding the fuel tank with a ferrous shield responsive to an indication of an inductive charging operation. Method 500 may then end.

Returning to 536, if it is indicated that fuel system pressure is greater than a threshold, method 500 proceeds to 544 and includes indicating the absence of undesired fuel system vapor emission. As undesired fuel system vapor emissions are not indicated, method 500 proceeds to 546 and includes closing or maintaining closed the CVV and opening the FTIV. With the FTIV open and the CVV closed, the Evap system may be isolated from atmosphere. As an absence of undesired vapor emissions is indicated at 544, monitoring the pressure via FTPT 291 (FIG. 2) may determine whether undesired vapor emissions are present at the canister side of the Evap system. Accordingly, at 548, method 500 includes monitoring Evap system pressure for a duration, the duration comprising a predetermined duration, for example a duration wherein a pressure build above a threshold is expected during an inductive charging event for an Evap system in the absence of undesired vapor emissions and an absence of undesired fuel tank vapor emissions.

Continuing at 550, method 500 includes indicating whether the Evap system pressure is greater than a threshold. The threshold value may be defined, for example, by a reference pressure obtained under control conditions in the absence of undesired Evap system vapor emissions, and may be further based on ambient temperature, fuel tank level, fuel tank temperature, etc. If at 550 it is indicated that Evap system pressure is not greater than a threshold, at 552 method 500 includes indicating undesired Evap system vapor emissions. For example, indicating undesired Evap system vapor emissions at 552 may include setting a diagnostic code or flag at the controller, and may further include illuminating a malfunction indicator lamp indicating the vehicle operator to service the vehicle Proceeding to 554, method 500 includes commanding closed the FTIV and commanding closed the CVV. As undesired Evap system vapor emissions is indicated, closing the FTIV seals the fuel tank from the Evap system, thus vapors from the fuel tank may not escape to the atmosphere. As the fuel system is comprised of a ferrous fuel tank, inductive charging may be allowed to proceed as the sealed fuel tank may be designed to withstand pressure increases associated with an inductive charging operation. In other examples, for instance a fuel system comprised of an aluminum or plastic fuel tank wherein a ferrous member coupled to the fuel tank is heated by the magnetic field thus heating the fuel tank, the fuel system may be sealed if the tank may withstand pressures associated with inductive heating, or alternatively the magnetic field may be decoupled from the ferrous member. Under circumstances wherein the fuel system is sealed and inductive charging may be continued, the fuel system may be monitored for pressure beyond a desired pressure associated. If a pressure rise beyond such a pressure level is indicated, the magnetic field may be decoupled from the ferrous fuel tank (or ferrous member). As described above, decoupling the magnetic field from the fuel tank may include shielding the fuel tank, or discontinuing inductive charging.

Proceeding to 530, method 500 includes updating fuel system and Evap system status to indicate an absence of undesired fuel system vapor emissions and the presence of undesired Evap system vapor emissions. At 530, updating may include increasing a canister purging operation schedule during engine on conditions, for example. Method 500 may then end.

Returning to 550, if it is indicated that the Evap system pressure is greater than a threshold, method 500 continues to 556 and includes indicating an absence of undesired Evap system vapor emissions. As an absence of undesired vapor emissions in the fuel system and Evap system are indicated, method 500 proceeds to 554 and includes closing the FTIV. For example, as the fuel tank is ferrous and may be designed to withstand pressures associated with inductive charging operation, inductive charging operations may proceed. Alternatively, if the fuel tank is aluminum or plastic, as described above, inductive charging operations may continue with the fuel tank sealed provided that the tank may withstand the pressure increases associated with inductive charging. If the fuel system is sealed and inductive charging operations are permitted to continue, fuel system pressure may be monitored and in the event that pressure rises above a level wherein further increases in pressure beyond a desired pressure, the magnetic field may be decoupled from the ferrous fuel tank (or ferrous member) as described above. In other examples, whether a ferrous tank or an aluminum or plastic tank, the magnetic field may be decoupled from the fuel tank (or ferrous member) subsequent to completion of the evaporative emissions test. In the condition where the fuel tank comprises an aluminum or plastic fuel tank, and the magnetic field is decoupled from the ferrous member subsequent to evaporative emissions testing, the FTIV and CVV may be commanded open such that fuel tank vapors may be directed to the vapor canister while the engine is off.

Proceeding to 530, method 500 includes updating fuel system and Evap system status to indicate an absence of undesired fuel system and Evap system vapor emissions. As such, updating the status of the fuel and Evap systems at 530 may include updating an evaporative emissions testing schedule based on an absence of undesired fuel and Evap system vapor emissions, for example. Method 500 may then end.

Returning to 508, if it is indicated that fuel system pressure is greater than a first threshold or less than a second threshold, method 500 proceeds to 514 where an absence of undesired fuel system vapor emissions is indicated. As an absence of undesired fuel system vapor emissions is indicated, the method proceeds to 516 and includes indicating whether the vehicle is being charged via inductive charging as described above. If at 516 it is indicated that the vehicle is not being charged via inductive charging, method 500 proceeds to 518 and includes maintaining the current vehicle status. For example, maintaining the current vehicle status at 518 may include maintaining the FTIV closed, and the CVV open. In another example, maintaining the current status of the vehicle may include maintaining the FTIV closed and the CVV closed such that any vapors present in the canister do not escape to atmosphere upon an increase in temperature, for example an increasing temperature due to a diurnal temperature cycle. Alternatively, if the vehicle is not equipped with a ferrous fuel tank, maintaining the current vehicle status may include commanding open the FTIV and commanding or maintaining open the CVV such that vapors from the fuel tank may be directed to the canister where they may be adsorbed prior to exiting to the atmosphere. Additionally, at 518, maintaining the current vehicle status may further include setting a flag at the controller indicating that an Evap system evaporative emissions test was not conducted, such that additional tests may be scheduled to determine the presence or absence of undesired Evap system vapor emissions.

Returning to 516, if it is indicated that inductive charging of the vehicle is in progress, method 500 proceeds to 520 and includes closing or maintaining closed the CVV and opening the FTIV. As described above, with the FTIV open and the CVV closed, the Evap system may be isolated from atmosphere. As an absence of undesired fuel system vapor emissions is indicated at 544, monitoring the pressure via FTPT 291 (FIG. 2) may determine the presence or absence of undesired Evap system vapor emissions. Accordingly, at 522 method 500 includes monitoring Evap system pressure for a duration as described above.

Continuing at 524, method 500 includes indicating whether the Evap system pressure is greater than a threshold. If at 524 it is indicated that Evap system pressure is not greater than a threshold, at 526 method 500 includes indicating undesired Evap system vapor emissions. For example, indicating undesired Evap system vapor emissions at 500 may include setting a diagnostic code or flag at the controller, and may further include illuminating a malfunction indicator lamp indicating the vehicle operator to service the vehicle.

Proceeding to 528, method 500 includes commanding closed the FTIV and commanding closed the CVV. As undesired Evap system vapor emissions is indicated, closing the FTIV seals the fuel tank from the Evap system, thus vapors from the fuel tank may not escape to the atmosphere. As described above with regard to 554, inductive charging may be allowed to proceed. Proceeding to 530, method 500 includes updating fuel system and Evap system status to indicate the absence of undesired fuel system vapor emissions and the presence of undesired Evap system vapor emissions. At 530, updating may include increasing a canister purging operations schedule during engine on conditions, for example. Method 500 may then end.

Returning to 528, if it is indicated that the Evap system pressure is greater than a threshold, method 500 continues to 532 and includes indicating that the absence of undesired Evap system vapor emissions. As undesired fuel system and Evap system vapor emissions are not indicated, method 500 proceeds to 528 and includes closing the FTIV. As described above, inductive charging may proceed if the fuel tank is sealed. Fuel system pressure may be monitored and in the event that pressure rises above a desired pressure, the magnetic field may be decoupled from the ferrous fuel tank (or ferrous member) as described above. In other examples, whether a ferrous tank or an aluminum or plastic tank, the magnetic field may be decoupled from the fuel tank (or ferrous member) subsequent to completion of the evaporative emissions test. In the condition where the fuel tank comprises an aluminum or plastic fuel tank, and the magnetic field is decoupled from the ferrous member subsequent to evaporative emissions testing, the FTIV and CVV may be commanded open such that fuel tank vapors may be directed to the vapor canister while the engine is off.

Proceeding to 530, method 500 includes updating fuel system and Evap system status to indicate an absence of undesired fuel system and Evap system vapor emissions. As such, updating the status of the fuel and Evap systems at 530 may include updating an evaporative emissions testing schedule based on an absence of undesired fuel and Evap system vapor emissions, for example. Method 500 may then end.

FIG. 6 shows an example timeline 600 for conducting an evaporative emissions test on a PHEV with a ferrous fuel tank where a magnetic field for inductive charging of the vehicle battery is coupled to the fuel tank, resulting in active pressure generation via the induced heating of the fuel tank, according to the methods described herein and with reference to FIG. 5, and as applied to the systems described herein and with reference to FIGS. 1-3. Timeline 600 includes plot 605, indicating whether a vehicle is inductively charging the battery, over time. Timeline 600 further includes plot 610, indicating the status of a CVV (e.g., 297, FIG. 2), and plot 615, indicating the status of a CPV (e.g., 261, FIG. 2) over time. Timeline 600 further includes plot 620, indicating pressure as monitored by a fuel tank pressure transducer, such as FTPT 291 (FIG. 2), over time. Line 625 represents a first threshold wherein a pressure level greater than the threshold indicates an absence of undesired vapor emissions, and line 635 represents a second threshold wherein a pressure level lower than the threshold indicates an absence of undesired vapor emissions, in an evaporative emissions test diagnostic. Further, line 630 represents a third threshold wherein a pressure level lower than the threshold indicates the presence of undesired vapor emissions in an evaporative emissions test diagnostic. Timeline 600 further includes plot 640, indicating whether a vehicle-off condition is detected, over time. Timeline 600 further includes plot 645, indicating whether undesired fuel system vapor emissions is indicated, and plot 650, indicating whether undesired Evap system vapor emissions is indicated, over time.

At time $t_0$ the vehicle is in operation, indicated by plot 640. The FTIV is closed, indicated by plot 615, the CVV is open, indicated by plot 610, and the fuel system pressure is near atmospheric pressure, indicated by plot 620. As the vehicle is in operation yet the fuel system pressure is near atmospheric pressure, the vehicle may be operating in battery only mode, thus heat is not being rejected from the engine to warm the fuel tank, and further the diurnal temperature cycle may in a portion of the cycle wherein fuel system pressure may be near atmospheric pressure (FIG. 4). As the vehicle is in operation, the vehicle is not charging the battery inductively, as indicated by plot 605. Undesired fuel system vapor emissions is not identified, indicated by plot 645, and undesired Evap system vapor emissions is not identified, indicated by plot 650.

At time $t_1$ a vehicle-off condition is indicated. As described above, a vehicle-off event may be indicated by a key-off event, a user setting a vehicle alarm upon exiting, or other suitable indicator. Further, at time $t_1$ it is indicated that the vehicle is inductively charging the vehicle battery. The inductive charging process may be indicated, for example, via communication between the energy storage device (e.g., 150) and the control system (e.g., 190), described above with regard to FIG. 1. As the fuel tank pressure is indicated to be near atmospheric pressure, additional tests may be conducted. Accordingly, as inductive charging is indicated, the magnetic field may be coupled to the fuel tank, thus generating heat resulting in a pressure rise in the fuel tank. As such, between time $t_1$ and $t_2$, fuel system pressure is monitored while the fuel system is sealed from atmosphere by maintaining the FTIV closed.

At time $t_2$ pressure in the fuel tank crosses a threshold, indicated by line 625. The threshold value may be defined, for example, by a reference pressure obtained under control conditions in the absence of undesired fuel system vapor emissions, and may be adjusted based on factors such as ambient temperature, fuel tank level, fuel tank temperature, etc. As the pressure build in the fuel system crossed the threshold at time $t_2$, undesired fuel system vapor emissions is not indicated, and the Evap system may be checked for undesired vapor emissions. As such, at time $t_2$ the FTIV may be commanded open, and the CVV may be commanded closed (or maintained closed if closed). Accordingly, by opening the FTIV and closing the CVV, pressure from the fuel tank generated via inductive heating of the fuel tank may function to further pressurize the Evap system.

Between time $t_2$ and time $t_3$, although inductive charging of the vehicle battery continues to heat the fuel tank, pressure in the Evap system as monitored by the FTPT does not remain stable or increase, but is instead observed to decrease over time. At time $t_3$ the pressure crosses a third threshold, indicated by line 630. As described above, the threshold value may be defined by a reference pressure obtained under control conditions in the absence of undesired Evap system vapor emissions and may be adjusted based on ambient temperature, fuel tank temperature, fuel level, and other such variables that may affect a pressure build in the Evap system. As the pressure in the Evap system steadily declined between time $t_2$ and $t_3$, crossing the third threshold at time $t_3$, undesired Evap system vapor emissions is determined, indicated by plot 650.

At time $t_3$, as undesired Evap system vapor emissions is indicated yet and absence of undesired fuel system vapor emissions is indicated, the FTIV is commanded closed to isolate the fuel system. As the vehicle is a PHEV with a ferrous fuel tank, the tank is designed to withstand the pressures generated during an inductive charging operation wherein the magnetic field from the primary coil is coupled to the fuel tank. As such, inductive charging of the vehicle battery may proceed even though undesired Evap system vapor emissions has been indicated, provided that the fuel system is sealed via closing of the FTIV. Thus, between time $t_3$ and $t_4$ pressure in the fuel tank rises and stabilizes while the vehicle undergoes the inductive battery charging operation.

At time $t_4$ the vehicle resumes operation. In one example, operating the vehicle includes driving the vehicle away from the charging mat. As such, inductive charging is no longer indicated as a result of the primary coil becoming decoupled from the secondary coil on the vehicle. Between time $t_4$ and $t_5$, the vehicle may be operating in a battery only mode during a portion of the diurnal temperature where temperatures are decreasing. As the engine is not running and thus heat is not being rejected to the fuel tank, and the ambient temperature is decreasing, fuel system pressure decreases accordingly.

In this way, opportunities for conducting evaporative emissions tests may be advantageously increased, specifically for vehicles such as HEVs and PHEVs, where engine run-time may be limited. For example, if a vehicle is operated primarily by battery power during the course of a previous drive cycle, heat rejection from the engine to the fuel tank may be inadequate for generating sufficient pressure for robust evaporative emissions testing. As such, actively pressurizing the fuel system and the Evap system enables evaporative emissions testing to be accomplished more frequently, and additionally the results obtained from the evaporative emissions testing procedure using active pressurization methodology may be more robust than typical results obtained using EONV techniques.

The technical effect of conducting evaporative emissions testing using active pressurization is to couple the magnetic field generated from a primary coil external to the vehicle to a ferrous fuel tank or ferrous member coupled to the fuel tank during an inductive charging operation in order to heat the fuel tank resulting in pressure increases in the fuel system and Evap system. In this way, active pressurization of the fuel system and Evap system may be accomplished without the use of an external pump, thus reducing costs, reducing space in the vehicle, and decreasing the opportunities for external pump malfunction. Further, by actively pressurizing the fuel system and Evap system for evaporative emissions testing procedures, execution of evaporative emissions tests may be enabled more frequently, thereby making it more likely that a completion frequency requirement may be met, thus limiting the release of evaporative emissions to the atmosphere.

The systems described herein and with reference to FIGS. 1-3, along with the methods described herein and with reference to FIG. 5 may enable one or more systems and one or more methods. In one example, a method comprises charging a battery of a hybrid electric vehicle by coupling a magnetic field between a primary coil external to the vehicle and a secondary coil onboard the vehicle; coupling the magnetic field between the primary coil and a ferrous fuel tank or ferrous member coupled to the tank; and comparing pressure in the fuel system and an emission system coupled to the tank to a reference pressure during a portion of the charging. In a first example of the method, the method further comprises sealing both the fuel system and the emission system together and indicating undesired vapor emissions in either the fuel system or the emission system when the pressure remains below the reference pressure for a predetermined time. A second example of the method optionally includes the first example and further comprises sealing the fuel system from the emission system and indicating undesired vapor emissions in the fuel system when a pressure in the fuel system remains below a preselected reference pressure for a preselected time. A third example of the method optionally includes any one or more or each of the first and second examples and further comprises: sealing the fuel system from the emission system and indicating undesired vapor emissions in the fuel system when a pressure in the fuel system remains below a preselected reference pressure for a preselected time; and indicating undesired vapor emissions in the emission system if undesired vapor emissions is indicated for both the emission system and the fuel system together, but not the fuel system separately. A fourth example of the method optionally includes any one or more or each of the first through third examples and further includes wherein undesired vapor emissions is indicated when the pressure in the tank and emission system remains below the reference pressure for a predetermined time, and decoupling the magnetic field from the tank in response to the indicated undesired vapor emissions. A fifth example of the method optionally includes any one or more or each of the first through fourth examples and further includes wherein the decoupling of the magnetic field from the tank comprises discontinuing an inductive charging operation. A sixth example of the method optionally includes any one or more or each of the first through fifth examples and further includes wherein the decoupling of the magnetic field from the tank comprises shielding the tank with a ferrous shield. A seventh example of the method optionally includes any one or more or each of the first through sixth examples and further includes wherein said shield comprises louvers moved to a closed position. An eighth example of the method optionally includes any one or more or each of the first through seventh examples and further comprises decoupling the magnetic field from the tank when the pressure in the fuel system and emission system rises above an undesired pressure. A ninth example of the method optionally includes any one or more or each of the first through eighth examples and further includes wherein vapors from the tank are adsorbed in a vapor storage material housed in a canister in the emission system.

An example of a system for a vehicle comprises a primary coil external to the vehicle configured to receive electrical power from an external power source for generating a magnetic field; a secondary coil onboard the vehicle configured such that the magnetic field generated from the primary coil induces a current in the secondary coil in a non-contact manner; a rechargeable battery configured such that the magnetic field generated from the primary coil inductively charges the battery via the induced current in the secondary coil; a fuel system comprising a ferrous fuel tank or a ferrous member coupled to the fuel tank positioned such that the magnetic field generated from the primary coil induces heat generation in the fuel tank; an evaporative emission system comprising a fuel vapor canister comprising an adsorbent for adsorbing fuel vapors from the fuel system via a fuel tank isolation valve, and coupled to an engine intake via a canister purge valve and to atmosphere via a canister vent valve; a fuel tank pressure transducer, positioned between the fuel tank and the fuel tank isolation valve and configured to monitor pressure in the fuel system when the fuel tank isolation valve is closed, and configured to monitor pressure in the fuel system and the evaporative emissions system when the fuel tank isolation valve is open and the canister vent valve is closed; a controller configured with instructions stored in non-transitory memory, that when executed cause the controller to: in response to an indication that the battery is being recharged via an inductive charging operation; compare pressure in the fuel system to a reference pressure where the fuel tank isolation valve is closed, and compare pressure in the fuel system and the evaporative emissions system to a reference pressure when the fuel tank isolation valve is open and the canister vent valve is closed. In a first example, the system further comprises indicating undesired fuel system vapor emissions when pressure in the fuel system remains below a reference pressure for a preselected time where the fuel system is sealed from the evaporative emissions system via closing the fuel tank isolation valve. A second example of the system optionally includes the first example and further comprises indicating undesired fuel system vapor emissions when pressure in the fuel system remains below a reference pressure for a preselected time where the fuel system is sealed from the evaporative emissions system via closing the fuel tank isolation valve; and indicating undesired evaporative emissions system vapor emissions when pressure in the fuel system and evaporative emissions system remains below a reference pressure for a preselected time where the fuel system is coupled to the evaporative emissions system via opening the fuel tank isolation valve and where the fuel tank and evaporative emissions system is sealed from atmosphere via closing the CVV, where undesired vapor emissions is not indicated in the fuel system alone. A third example of the system optionally includes any one or more or each of the first and second examples and further includes wherein indicating undesired vapor emissions in the fuel system comprises decoupling the magnetic field from the fuel tank responsive to the indicated undesired vapor emissions, where decoupling includes one or more of shielding the fuel tank from the magnetic field with a ferrous shield, or discontinuing an inductive charging operation. A fourth example of the system optionally includes any one or more or each of the first through third examples and further includes wherein indicating undesired evaporative emissions system vapor emissions comprises sealing the fuel system via closing the fuel tank isolation valve responsive to the indicated undesired evaporative emissions system vapor emissions. A fifth example of the system optionally includes any one or more or each of the first through fourth examples and further includes wherein sealing the fuel system via closing the fuel tank isolation valve responsive to the indicated undesired vapor emissions further comprises continuing an inductive charging operation. A sixth example of the system optionally includes any one or more or each of the first through fifth examples and further comprises decoupling the magnetic field from the fuel tank when the pressure in one or more or each of the fuel tank and the evaporative emissions system reaches an undesired pressure.

Another example of a method comprises during a vehicle-off condition, inductively heating a ferrous fuel tank or a ferrous member coupled to a fuel tank; and indicating undesired fuel system vapor emissions including the fuel tank in response to a pressure in the fuel system remaining below a reference pressure for a predetermined time. In a first example of the method, the method includes wherein inductively heating the fuel tank or ferrous member coupled to the fuel tank includes an inductive battery charging operation where a primary coil external to the vehicle generates a magnetic field that induces a current in a secondary coil onboard the vehicle for charging a vehicle battery, the magnetic field further generating heat in the fuel tank or ferrous member. A second example of the method optionally includes the first example and further comprises decoupling the magnetic field from the fuel tank when the pressure in the fuel tank rises above an undesired pressure.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

charging a battery of a hybrid electric vehicle by coupling a magnetic field between a primary coil external to the vehicle and a secondary coil onboard the vehicle;

coupling the magnetic field between the primary coil and a fuel tank, the fuel tank being a ferrous fuel tank or a ferrous member being coupled to the fuel tank;

comparing pressure in a fuel system and/or an emission system coupled to the fuel tank to a reference pressure during a portion of the charging to indicate a presence or an absence of undesired vapor emissions in the fuel system and/or the emission system; and decoupling the magnetic field from the fuel tank via shielding the fuel tank with a ferrous shield in response to the presence of undesired vapor emissions.

2. The method recited in claim 1, further comprising sealing both the fuel system and the emission system together and indicating the presence of undesired vapor emissions in either the fuel system or the emission system when the pressure remains below the reference pressure for a predetermined time.

3. The method recited in claim 2, further comprising: sealing the fuel system from the emission system and indicating the presence of undesired vapor emissions in the fuel system when the pressure in the fuel system remains below a preselected reference pressure for a preselected time; and indicating the presence of undesired vapor emissions in the emission system if undesired vapor emissions are indicated for both the emission system and the fuel system together, but not the fuel system separately.

4. The method recited in claim 1, further comprising sealing the fuel system from the emission system and indicating the presence of undesired vapor emissions in the fuel system when the pressure in the fuel system remains below a preselected reference pressure for a preselected time.

5. The method recited in claim 1, wherein the decoupling the magnetic field from the tank further comprises discontinuing the charging the battery without shielding the fuel tank with the ferrous shield.

6. The method recited in claim 1, wherein the ferrous shield comprises louvers moved to a closed position.

7. The method recited in claim 1, further comprising decoupling the magnetic field from the fuel tank when the pressure in the fuel system and emission system rises above an undesired pressure.

8. The method recited in claim 1, wherein vapors from the fuel tank are adsorbed in a vapor storage material housed in a canister in the emission system.

* * * * *